United States Patent [19]

Hasegawa

[11] Patent Number: 4,654,934

[45] Date of Patent: Apr. 7, 1987

[54] COVERED BUTTON

[75] Inventor: Kenji Hasegawa, Fujisawa, Japan

[73] Assignee: Scovill Japan Kabushiki Kaisha, Tokyo, Japan

[21] Appl. No.: 832,285

[22] Filed: Feb. 21, 1986

[30] Foreign Application Priority Data

Mar. 4, 1985 [JP] Japan ..... 60-29717[U]

[51] Int. Cl.[4] ..... A44B 1/12; A44B 1/38

[52] U.S. Cl. ..... 24/113 R; 24/90 C; 24/92; 24/106

[58] Field of Search ..... 24/92, 113 R, 90 C, 24/90.5, 93, 103, 106, 621, 623

[56] References Cited

U.S. PATENT DOCUMENTS

| | | | |
|---|---|---|---|
| 2,513,182 | 6/1950 | Koehl et al. | 24/113 R |
| 2,881,495 | 4/1959 | Koehl | 24/113 R |
| 3,449,802 | 6/1969 | Mackey | 24/113 R |
| 3,534,446 | 10/1970 | Silver | 24/92 |
| 3,771,199 | 11/1973 | Eldringhoff | 24/92 |
| 4,549,331 | 10/1985 | Coley | 24/113 R |

FOREIGN PATENT DOCUMENTS

| | | | |
|---|---|---|---|
| 408824 | 6/1945 | Italy | 24/113 R |
| 831316 | 3/1960 | United Kingdom | 24/113 R |

*Primary Examiner*—Victor N. Sakran

*Attorney, Agent, or Firm*—Panitch Schwarze Jacobs & Nadel

[57] ABSTRACT

A covered button comprises a button body consisting of a mushroomlike head and a shank, a covering material covering the head and a washer adapted to retain the peripheral edge of the covering material in position on the back of the head. The inner periphery of the washer bites into the shank to prevent it from dislodging.

2 Claims, 7 Drawing Figures

COVERED BUTTON

FIELD OF THE INVENTION

This invention relates to a covered button, and in particular to a covered button provided with a washer to secure the covering material in place.

DESCRIPTION OF THE PRIOR ART

Heretofore, some types of covered buttons have been known. They include one, as illustrated in FIG. 1, which comprises a mushroomlike button body 2 covered with a small piece of fabric or other covering material 1, the covering piece being extended over the outer periphery of the button head into the back side or the cavity of the button body, and a washer 3 fitted in the cavity, with a circumferential grooved formed thereon in engagement with a rib formed on the inner periphery of the head, thereby securing the peripheral edge of the covering piece firmly in between. Another type, shown in FIG. 2, uses a fabrication shell 6 of sheet metal wrapped with a piece of covering material 7 and crimped on the periphery of a button body by pressing for deformation in the direction of the arrow, together with the covering piece to secure the latter in place. In another known structure, as in FIG. 3, a small piece of covering fabric 12 covers a front member 8 including its downwardly extending periphery 9, with the edge of the fabric piece folded inside, and a back member 10 is fitted in the cavity of the front member 8, with its inwardly extending periphery 11 holding the edge of the covering fabric 12 between itself and the downwardly extending periphery 9 of the front member, and then the latter periphery is crimped inwardly to fix the fabric piece in place.

The structural feature common to these covered buttons, or the edge of the covering material pinched between the two members, necessarily increases the height of the periphery of such a button. This in turn adds to the overall thickness of the button as attached to a piece of garment or the like, often impairing the appearance of the buttoned product. Another problem, especially to the type shown in FIG. 2, is the necessity of a relatively strong force to press and deform the fabrication shell. When a hand or foot press, or other simple means is employed for the work, the burden on the operator can build up to a disadvantage in operation efficiency.

OBJECT OF THE INVENTION

The object of this invention is to overcome the foregoing difficulties involved in the manufacture of the existing covered buttons and provide a covered button which presents a more attractive appearance when attached to a piece of garment or the like with less labor requirement for its manufacture.

More specifically, the object of the invention is to provide a covered button of smaller overall thickness than the prior art covered buttons.

Further object is to provide a covered button of the aforesaid type which can be easily assembled.

SUMMARY OF THE INVENTION

The present invention provides a covered button of generally small thickness comprising a button body which has a mushroom-like head covered with a piece of covering material and a hollow shank formed inside, a washer fitted onto the hollow shank and which securely presses the peripheral edge of the covering piece in place, the washer being formed with a plurality of leaf-spring-like projections having edges adapted to fit and engage the outer surface of the hollow shank in wedgelike fashion so that the washer may be movable in only the direction for compressing the covering material and be caused to take firm hold of the shank by dint of the force exerted in the direction reverse to the covering-material-compressing direction, and a backing member of any desired design adapted to be joined to the covered button body through a piece of garment or the like to which the button is to be attached.

BRIEF DESCRIPTION OF THE DRAWINGS

FIG. 7 is a sectional view of the covered button as attached to a garment or the like.

DESCRIPTION OF THE EMBODIMENT

Figure 4:
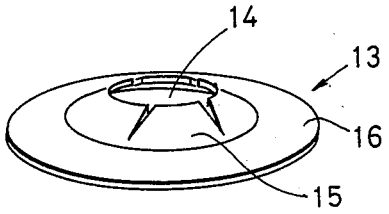
FIG. 4 is a perspective view of the washer according to this invention.

FIG. 4 is a perspective view of a washer to be used in conformity with the invention. The washer 13 consists of a disklike flat portion 16 for pressing and fixing a piece of covering material in place, and a plurality of leaf-spring-like projections 15 extending radially inwardly of the flat portion, with a gradual descent to a given length, until they terminate convergently. The terminating edges of the inward projections 15 from a center opening 14 of a diameter slightly smaller than the outside diameter of a hollow shank, designated at 19 in FIG. 5, of a button body.

Figure 6:
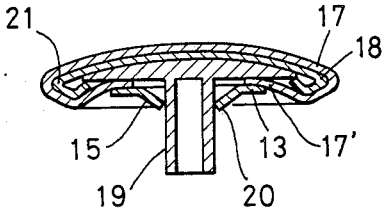
FIG. 6 is a sectional view of the button body, as covered, of the covered button embodying the invention.
Figure 3:
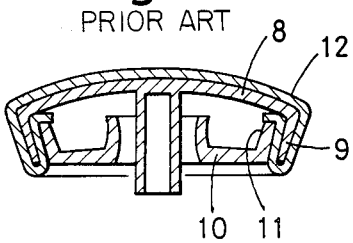
Fig. 3 PRIOR ART
Figure 5:
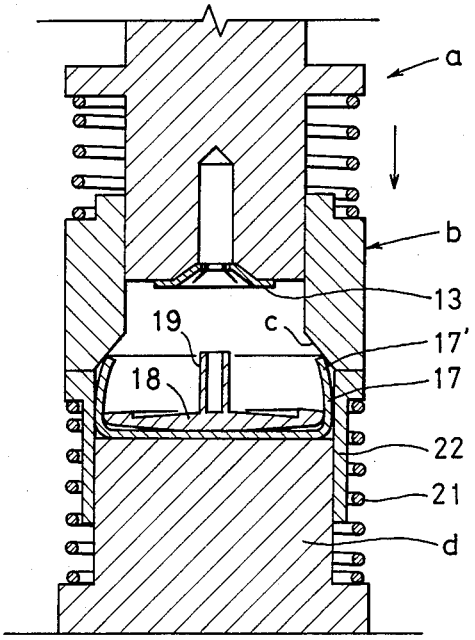
FIG. 5 is a schematic sectional view of an apparatus for assembling a covered button of the invention and of the components of the button in relative position therein.

An embodiment of a button body to be assembled together with the washer 13 is illustrated in FIGS. 5 and 6. The button body 18 comprises a mushroom-like flange having a peripheral bead 21 and a central hollow shank 19. A piece of covering material 17 is the other member for forming the covered button. As the peripheral bead 21 is not required to fit with the washer periphery, the thickness of the bead is usually made small compared with the periphery of the conventional covered buttons. However, the bead is preferred to increase friction to the covering material 17 to firmly retain it in place.

In assembling a covered button of the present invention an apparatus a schematically illustrated in FIG. 5 is used. The washer 13 is charged into a cylindrical upper part b of the apparatus, with its leaf-spring-like projection side up, and is positioned so that its opening 14 is aligned with the hollow shank 19 of the button body 18 below the washer. The button body is placed on a larger piece of covering material 17 and is held together by a link 22, which in turn is vertically movably supported by a lower part d of the apparatus a and a compression spring 21 coiling round the lower part and the link alike. As the upper part b of the apparatus a is lowered, the peripheral edge portion 17' of the covering piece extending beyond the peripheral of the button body is folded inward by a guiding bevel c formed on the inner end of the cylindrical upper part b. With a further downward movement of the upper part, the washer is forced onto the hollow shank 19 of the button body, guided by its outer surface, so that the flat portion 16 of the washer engages the edge portion 17' of the covering piece already folded back radially inward. The washer is then lowered to a preset position where it firmly presses the peripheral edge portion 17' of the covering material with the flat portion 16 to provide an integral joint of the two portions.

Since the diameter of the opening in the center of the washer 13 is slightly smaller than the outside diameter of the hollow shank 19 of the button body as noted above, the washer is forced onto the shank with the individual leaf-spring-like projections 15 slightly forced apart radially outward along the shank surface. When the washer has been completely fitted in position as indicated in FIG. 6, the inner edges 20 of the leaf-spring-like projections 15 that define the opening of the washer 13 take firm hold of the outer surface of the hollow shank by dint of the springback of the compressed covering piece. Thus, the washer and covering material can be secured together, the latter being in a tightly compressed state, in the preset position without the need of any extra fastening means.

Under the invention, as is obvious from the foregoing description, the piece of covering material 17 is firmly pressed in position when the washer 13 is simply fitted onto the hollow shank 19 and forced down to a preset point. Moreover, because the washer 13 is provided with the leaf-spring-like projections to be guided by the outer surface of the shank, it can be urged into the eventual position by the application of only a slight downward force.

Figure 1:
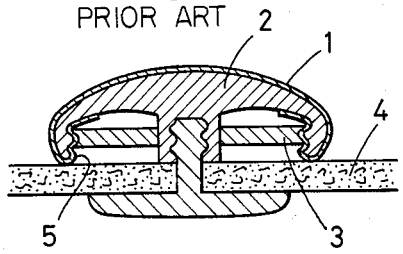
Fig. 1 PRIOR ART
FIGS. 1 to 3 are sectional views of typical covered buttons of the prior art.
Figure 2:
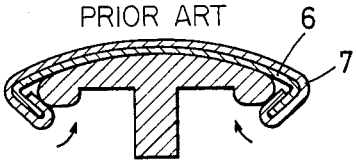
Fig. 2 PRIOR ART
Figure 7:
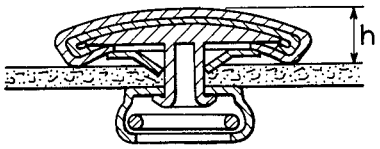

According to this invention, the periphery 21 of the button body need not be specially shaped (for example, extended downward as in FIG. 1), because the covering material 17 is adequately pressed in place at the edge by only the flat portion 16 of the washer. This renders it possible to decrease the height h of the button as measured from the surface of a garment or the like to which it has been attached as shown in FIG. 7. The covered button of the invention thus replaces the conventional ones that unnecessarily protrude beyond and tend to mar the appearance of the buttoned product, and instead improves the appeal of the garment or the like.

While the invention has been described in connection with an embodiment thereof, it is to be noted that various changes and modifications may be made within the spirit and scope of the invention.

I claim:

1. A covered button including a button body which has a mushroomlike head covered with a piece of covering material and a shank formed inside, and a washer fitted onto the shank and which securely presses the fold-back peripheral edge of the covering material in place, characterized in that the washer is provided with a plurality of leaf-spring-like projections extending radially inwardly and away from said head and terminating in edges defining a hole having a diameter smaller than that of said shank, whereby the covering material is held in place by the washer, with the edges of the projections firmly engaging the shank under the springback urging of the covering material as well as the resiliency of said projections.

2. A covered button according to claim 1 wherein the mushroomlike head of the button body, covered with the covering material, has an overall thickness less than those of conventional covered buttons.

* * * * *